US005087000A

United States Patent [19]

Suto

[11] Patent Number: 5,087,000

[45] Date of Patent: Feb. 11, 1992

[54] TOY AIRPLANE

[75] Inventor: Shohei Suto, Tokyo, Japan

[73] Assignee: Taiyo Kogyo Co., Ltd., Tokyo, Japan

[21] Appl. No.: 665,804

[22] Filed: Mar. 7, 1991

[30] Foreign Application Priority Data

Apr. 20, 1990 [JP] Japan ..... 2-41561[U]
Oct. 17, 1990 [JP] Japan ..... 2-108035[U]

[51] Int. Cl.[5] ..... B64C 13/20

[52] U.S. Cl. ..... 244/189; 244/190; 244/51

[58] Field of Search ..... 244/189, 190, 51, 75 R; 446/57, 58; 340/825.69, 825.72, 341.146

[56] References Cited

U.S. PATENT DOCUMENTS 3,806,939 4/1974 Palmieri ..... 340/825.69
3,957,230 5/1976 Boucher et al. ..... 244/53 R
4,038,590 7/1977 Knowlton ..... 340/825.69
4,143,307 3/1979 Hansen et al. ..... 244/190
4,168,468 9/1979 Mabuchi et al. ..... 340/825.69
4,198,779 4/1980 Kress ..... 446/58
4,760,392 7/1988 Yamamoto et al. ..... 340/825.72

*Primary Examiner*—Joseph F. Peters, Jr.
*Assistant Examiner*—Anne E. Bidwell
*Attorney, Agent, or Firm*—Edward D. C. Bartlett

[57] ABSTRACT

A radio controlled toy airplane has an airframe with a fixed vertical tail plane, a fixed horizontal tail plane, and at least one set of rightside and leftside propellers. The rotational outputs of the propellers are controlled discretely and continuously or in a staged manner, respectively, via a remotely located radio transmitter. This transmitter has two manual control sticks, one for controlling total combined power to the propellers and the other for adjusting the power distribution between the propellers, and in this way flight of the toy airplane is solely controlled by controlling motors which separately drive the propellers. The motors may be battery powered.

9 Claims, 4 Drawing Sheets

TOY AIRPLANE

FIELD OF THE INVENTION

The present invention relates to a toy airplane of a propeller-driven type and, more particularly, to a radio controlled toy airplane which has propellers on both the right and left sides of the airframe.

BACKGROUND OF THE INVENTION

A propeller-driven type model airplane utilizing radio control usually has single or twin propellers provided on the airframe; it is a toy for play wherein these propellers are driven by a motor, an engine or the like, so that the toy plane can be made to fly freely in the air. Such model airplanes, whether they are single-motored or twin-motored, obtain their propulsive force from the propellers being rotated with prescribed outputs. They are so designed that the airframe can be operated in an arbitrary direction, rightward or left-ward, or upward or downward, by controlling discretely a rudder provided in a vertical tail plane and an elevator provided in a horizontal tail plane, or the like, respectively.

The propellers of the prior-art model airplanes, irrespective of whether the airplane is single-motored or twin-motored, are employed only for driving the airframe, and the elevator or the rudder is required and used for directing the airframe upward or downward, or rightward or leftward. For such model airplanes, accordingly, a control servo and a mechanical mechanism for controlling the elevator and the rudder are necessary, and thereby the structure is complicated and the weight increased. In addition, a driving source for the propellers is required to have a large output, and this all results in an increase in the cost of the toy as a whole. Moreover, in respect to such control of the elevator and the rudder, responsiveness to changes in direction and elevation for the radio controlled toy is not good, and this causes another problem that remote controlled operation of the toy plane is not easy.

SUMMARY OF THE INVENTION

In view of the above problems, the present invention is concerned with furnishing a toy airplane which has a simplified mechanism, a reduced weight, enables reduction in cost, and/or has improved operability.

Broadly, the present invention provides a radio controlled toy airplane having an airframe provided with a fixed vertical tail plane, a fixed horizontal tail plane, at least one set of rightside and leftside propellers, and means for controlling rotational output of these propellers discretely and continuously or in a staged manner respectively.

The rotational outputs of the right and left propellers are controlled by radio control such that the outputs of both propellers are the same and are kept equal as they are changed, or the output of one propeller can be changed with respect to the output of the other propeller. The airframe is thus steered, elevated and completely controlled by control of the outputs of the propellers, and is so operated without any adjustment or control of an elevator or a rudder. In this way, the mechanism is simplified, the weight is made lighter, the cost can be reduced consequently, and operability is also improved.

According to one aspect of the present invention, there is provided a toy airplane comprising an airframe provided with a fixed vertical tail plane and a fixed horizontal tail plane, two propellers rotatably mounted on opposite sides of the airframe, and rotating means for independently drivably rotating the two propellers. Power output means is provided for controlling the combined total rotational output of the two propellers, power balance means is provided for adjustably proportioning the distribution of the combined total rotational output between the two propellers, and a radio control system incorporates the power output means and the power balance means for remote control of flight of the airframe.

The radio control system preferably comprises a radio receiver circuit in the airframe and a remote transmitter. This transmitter may have a control stick for manually controlling the power output means and a separate control stick for manually controlling the power balance means.

According to another aspect of the invention, there is provided a toy airplane including a winged fuselage having a fixed tail plane assembly with not a single adjustable elevator or rudder anywhere, right and left propeller units each having a separate electric drive motor and being mounted on opposite sides of the winged fuselage, and a control unit accommodated by the winged fuselage and including a circuit for receiving radio control signals. The control unit includes motor control means for operating both of the drive motors in unison by proportionally increasing or decreasing the power to each motor, and means for separately varying the power distribution between the two motors to enable either motor to run at higher power than the other, flight of the winged fuselage being solely controlled by controlling the motors.

According to yet another aspect of the invention, there is provided a toy airplane comprising an airframe having a fixed tail assembly without any elevator or rudder, two propeller units, one to a right side of the airframe and the other to a left side of the airframe, each propeller unit including its own electric motor drivingly connected to a rotatable propeller, and a battery or battery pack accommodated by the airframe for supplying power to the electric motors. A radio receiver and motor control unit is accommodated by the airframe and has two output channels, one output channel controlling delivery of total combined power from the battery to both of the motors, and the other output channel controlling distribution of this total combined power between the two motors. A radio transmitter unit, for transmitting radio signals from a remote location to said control unit, has two separately operable user controls, one user control for determining and controlling the one output channel and the other user control for determining and controlling the other output channel.

Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings, in which like reference characters in the same or different FIGS. indicate like parts.

DETAILED DESCRIPTION OF THE PREFERRED EMBODIMENT

The preferred embodiment of the present invention is illustrated, by way of example, in FIGS. 1 to 4 and will now be described in greater detail.

Figure 1:
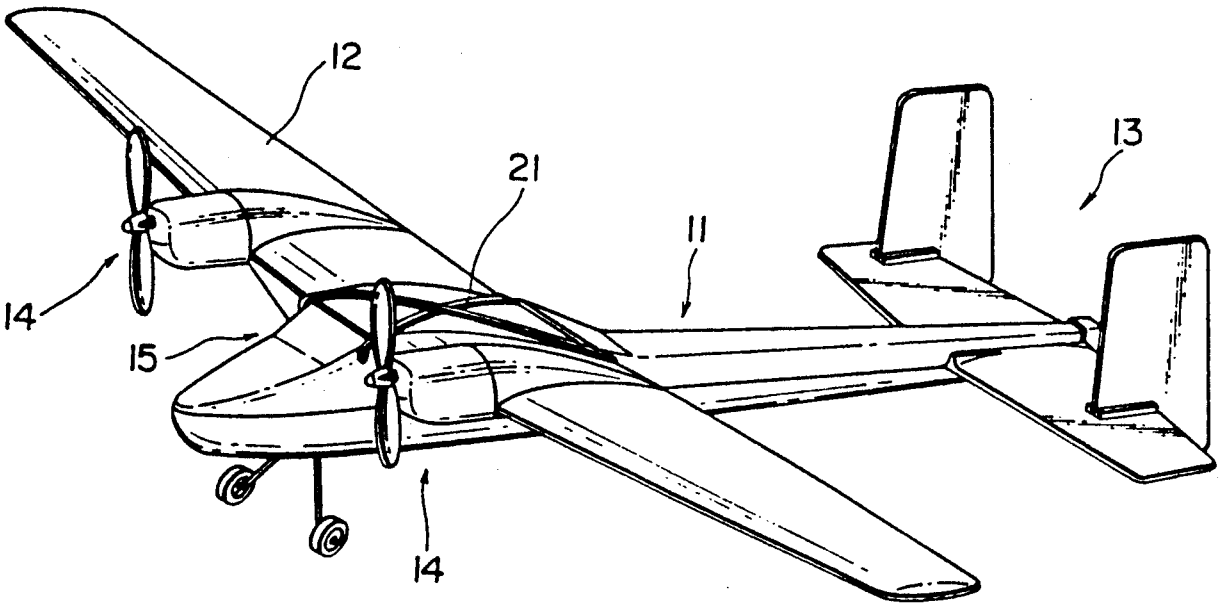
FIG. 1 is a perspective view of a toy airplane according to the present invention.
Figure 2:
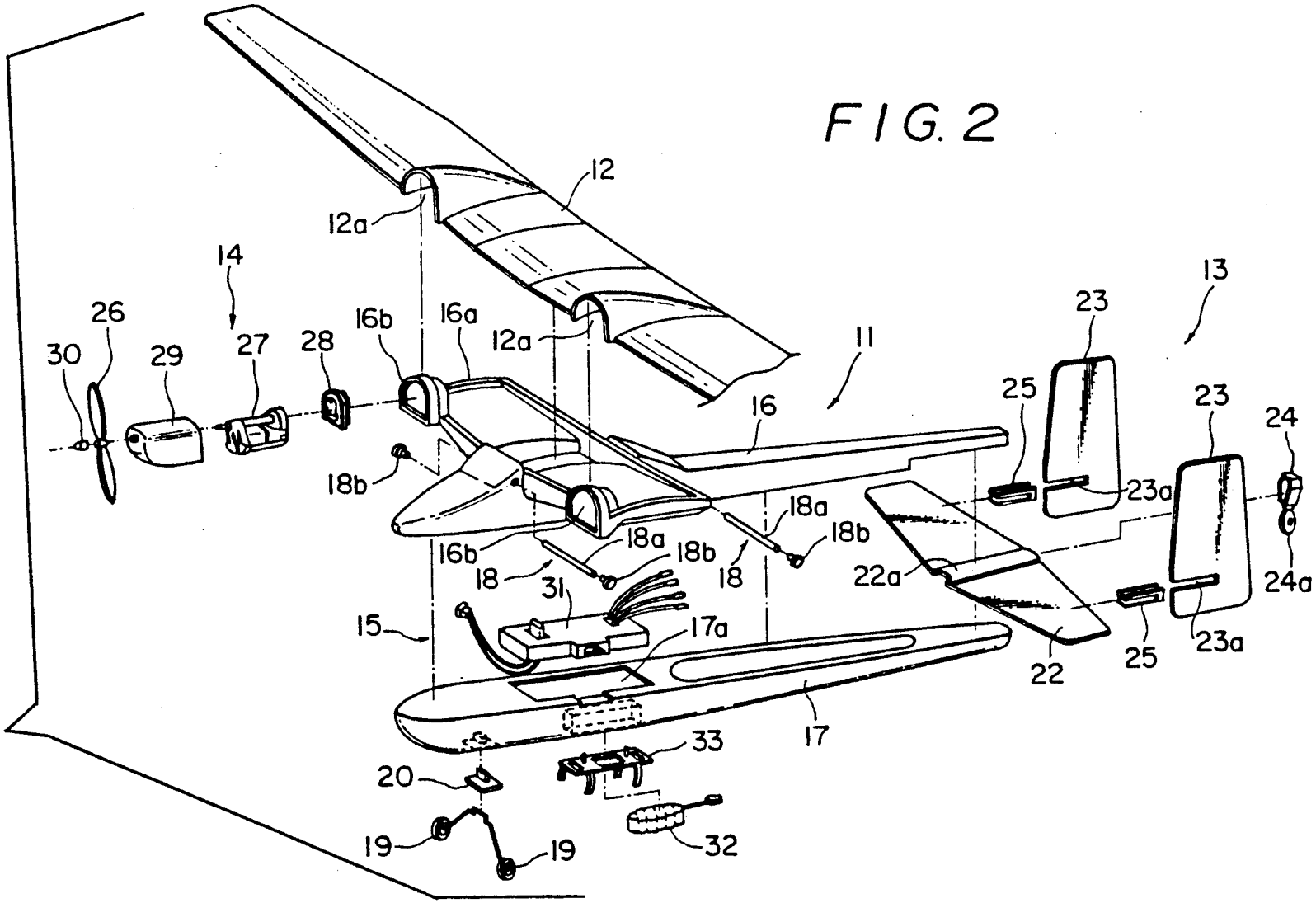
FIG. 2 is an exploded perspective view of the toy airplane of FIG. 1.

In FIGS. 1 and 2, the toy airplane comprises a fuselage assembly 11, a main plane 12, a tail-plane assembly 13, twin-motored right and left propeller assemblies 14, 14 and a control assembly 15.

The fuselage assembly is made up of a material prepared by laminating a resin film on the surface of foamed plastic which is light in weight, or the like, and has the external appearance shaped in an imitation of the fuselage of a real airplane. This fuselage is formed of an upper body part 16 and a lower body part 17 joining along a horizontal plane, these body parts being shown spaced apart vertically in FIG. 2. The upper body part 16 has a main-plane, or main wing, fitting part 16*a* shaped in a wing mounting frame. This mounting frame 16*a* juts out to the right and left of the fuselage for fitting and mounting the main plane 12, and has formed in the upper part of the front side thereof an imitation cockpit. This mounting frame 16*a* has a pair of propeller fitting parts 16*b*, 16*b* for fitting the right and left propeller assemblies 14, 14 and which parts 16*b* are formed in the outboard end parts of the front side of said main-plane fitting frame 16*a*. In front of and to the rear of the main-plane fitting part 16*a* of the upper body 16, band stoppers 18, 18 for fitting the main plane 12 are provided respectively. Each of these band stoppers 18 is formed by a slender rod 18*a* with caps 18*b* attached to opposite ends of each rod. The lower body 17 has a compartment 17*a* for accommodating a control unit to be described later, and a battery, the compartment 17*a* being formed at the front end of the body part 17. A wire fitted with a pair of wheels 19, 19 is mounted on the lower part of the front end of the lower body 17 by a wheel holder 20.

The main plane 12 is made up of the same material as the fuselage assembly 11 (as also is the tail-plane assembly 13), and it is formed to provide long and narrow wings symmetric with respect to each other and the fuselage 11. At symmetric positions on the front side of this main plane 12, protuberant parts 12*a*, 12*a* are formed and made to engage with the upper parts of the propeller fitting parts 16*b*, 16*b*. The main plane 12 is fitted to the upper body 16 by stretching a rubber band 21 over the central part of the main plane 12 and fastening opposite ends of the rubber band 21 to the band stoppers 18, 18. By securing the main plane 12 by the rubber band 21 in this way, damage to the main plane 21, when an unexpected impact is given thereto, is prevented or mitigated by the elasticity of the rubber band 21.

The tail-plane assembly 13 comprises a horizontal tail plane 22, and a pair of vertical tail planes 23. The horizontal tail plane 22 has a guide part 22*a* formed in the central part thereof. This guide part 22*a* is held between the rear ends of the upper body 16 and the lower body 17 and fixed therebetween by putting a tail cap 24 over the rear end parts of these body parts 16, 17. A wheel 24*a* is mounted on the lower part of this tail cap 24. The two identical vertical tail planes 23 each have a slit 23*a* 10 formed in the horizontal direction at the lower end thereof. The two tail planes 23 are fitted to symmetrical positions on the horizontal tail plane 22 by means of vertical tail plane fitting stays 25, 25 which are so inserted into said slits 23*a* , 23*a* as to engage therewith.

The rightside and leftside propeller assemblies 14 comprise plastic propellers 26, speed change gears 27 connected directly to output shafts of the propellers 26 and having small electric motors incorporated (shown in FIG. 4), holders 28 for mounting the speed change gears 27 in the propeller fitting parts 16*b* of the upper body 16, covers 29 covering the speed change gears 27 and the electric motors, and propeller caps 30 fitted to the fore-end parts of the propellers 26.

The control assembly 15 comprises a control unit 31 having a reception circuit, a control circuit for rotational output of the propellers, a battery 32, a battery holder 33, all accommodated in the compartment 17*a* of the lower body part 17. The battery 32 is connected to a power supply input wire of the control unit 31, and output wires of the control unit 31 are connected to motors of the speed change gears 27,27 respectively. The control unit 31 receives signals sent from a transmitter of a radio control unit (see FIG. 3) and, in response to these signals, varies the rotational outputs of the electric motors of the speed change gears 27, 27 individually from each other and continuously between the minimum output (0) and the maximum output (100). The assembled toy airplane is so set that the airframe ascends when both the rotation outputs of the right and left propellers 26, 26 are maximum, and that the airframe keeps a level flight when both of the outputs are, for instance, at about 70, i.e. 70% of maximum output.

The transmitter of the radio control (see FIG. 3) is provided with control sticks for effecting this variation of the rotational outputs of the right and left propellers 26, 26 discretely from each other and continuously respectively.

Figure 3:
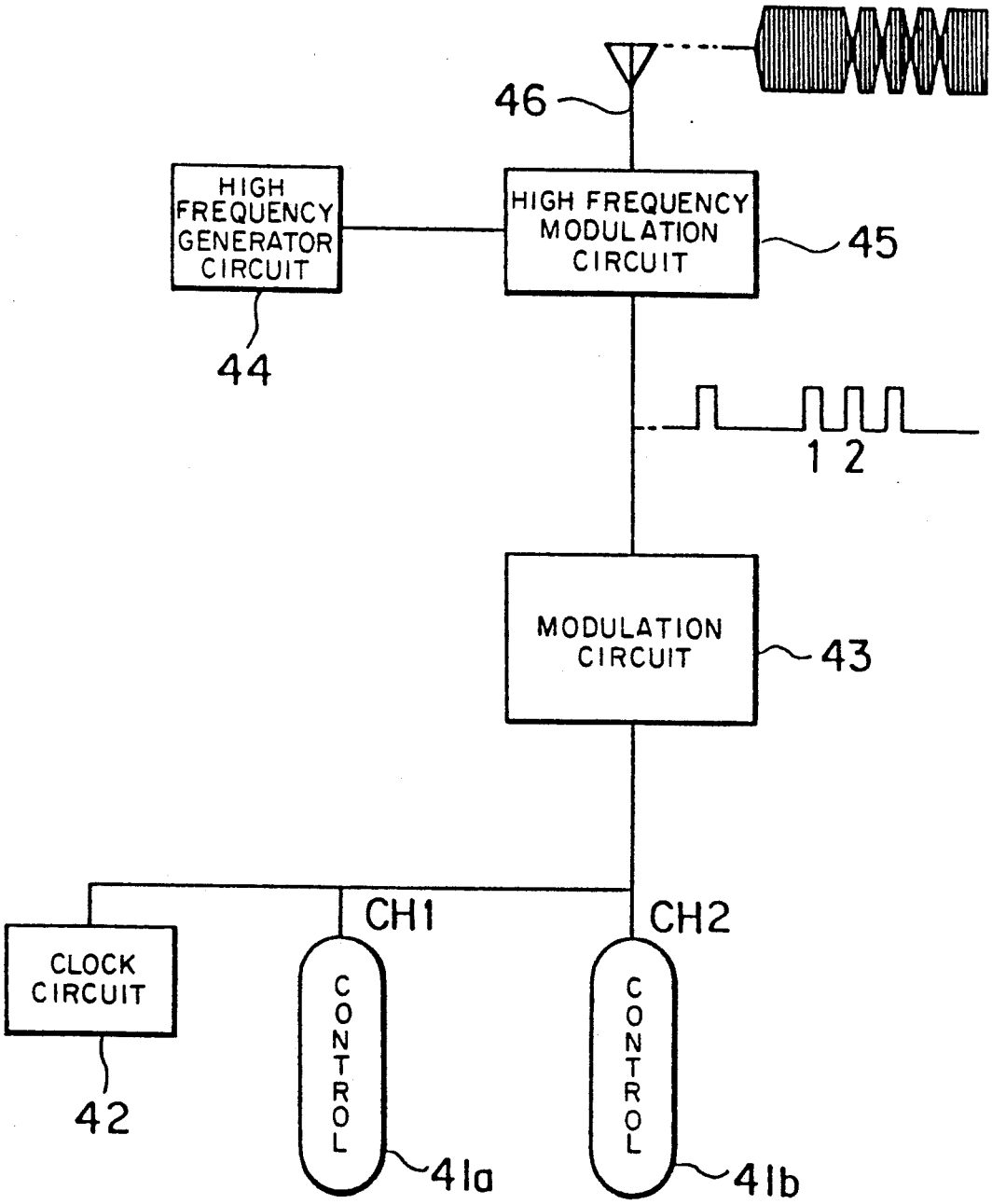
FIG. 3 is a block diagram illustrating a transmitter circuit according to the invention for remote control of the toy airplane of FIGS. 1 and 2.
Figure 4:
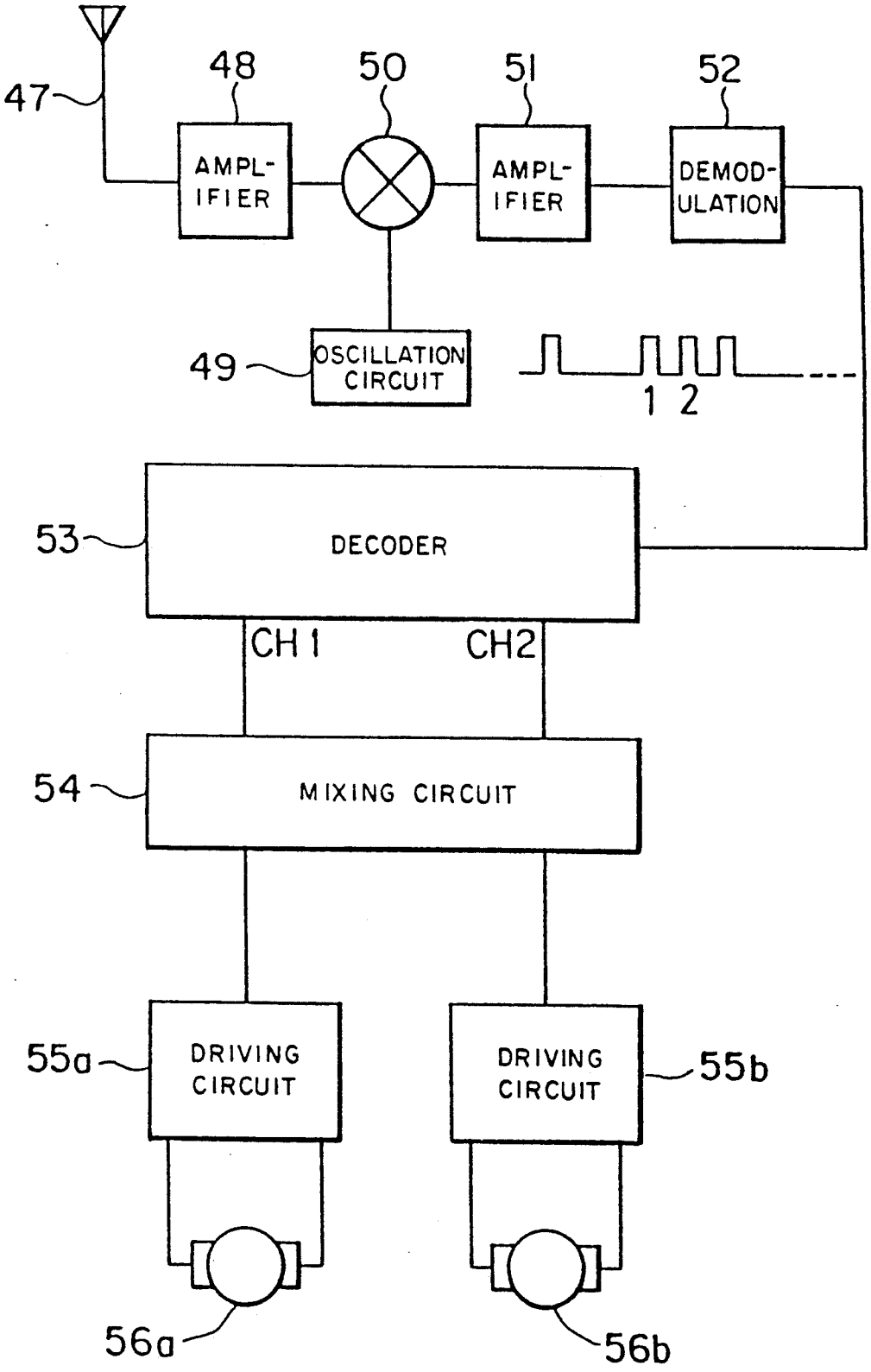
FIG. 4 is a block diagram illustrating a receiver and motor control circuit according to the invention of the toy airplane of FIGS. 1 and 2.

FIG. 3 is a block diagram showing a transmitter circuit of the embodiment of the present device, and FIG. 4 is a block diagram showing a receiver circuit of the embodiment of the present device.

In FIGS. 3 and 4, a transmitter and a receiver constituting a radio control system of the toy airplane are based on a proportional control system by digital signals, and pulse position modulation is used for a decoder circuit and others thereof. Control signals, given respectively by control sticks 41*a*, 41*b* of a first channel (CH1) and second channel (CH2) operated on the transmitter side, are transmitted as radio waves. These radio waves are received by the receiver based on a superheterodyne system, and the rotational outputs of the right and left propellers 26, 26 are accordingly able to be varied discretely and in unison, respectively. The reception circuit corresponds to the control unit 31 of the above-mentioned control assembly 15.

In the transmitter circuit of FIG. 3, the control sticks 41*a* and 41*b* of the first channel and second channel each include gearing with potentiometers and other components for inputting operation signals for power control and power balance. A clock circuit 42 generates a basic pulse. A modulation circuit 43 obtains a signal for setting a timing for a pulse position corresponding to an operation amount or position of each of the control sticks. A high-frequency generating circuit 44 generates a carrier wave, and a high-frequency modulation circuit 45 imposes the high-frequency control signal on the carrier wave for transmission via a transmitter antenna 46.

The receiver circuit of FIG. 4 comprises a receiver antenna 47, a high-frequency amplifier circuit 48, a local oscillation circuit 49, a mixing circuit 50, an intermediate-frequency amplifier circuit 51, an amplitude demodulation circuit 52 by detection or the like, and a decoder circuit 53 outputting a power control signal of the first channel (CH1) and a power balance signal of the second channel (CH2) in parallel according to demodulation signals. A mixing circuit 54 receives this power control signal and this power balance signal as two inputs, and from these produces control signals for driving the right and left motors. Two separate driving circuits 55*a*, 55*b* are separately fed from the mixing circuit 54 for individually driving the right and left motors 56*a* and 56*b*, respectively.

In the mixing circuit 43 on the transmitter side (FIG. 3), a timing signal setting a pulse position corresponding to the degree of movement of the control sticks 41*a* and 41*b* in relation to the basic pulse generated in the clock circuit 42 is outputted. This signal is put on the carrier wave, generated in the high-frequency generating circuit 44, by the high-frequency modulation circuit 45, and transmitted as a radio wave from the transmitter antenna 46. This radio wave is received by the receiver antenna 47 on the receiver side (FIG. 4) and demodulated as a signal containing the operation signals of the first channel (CH1) and the second channel (CH2) by the high-frequency amplifier circuit 48, the local oscillation circuit 49, the mixing circuit 50 and the amplitude demodulation circuit 52. A demodulation signal thus obtained is separated into the power control signal of the first channel (CH1) and the balance signal of the second channel (CH2) and outputted by the decoder circuit 53. These two signals are inputted to the mixing circuit 54, and control signals for driving the motor 56*a* and motor 56*b* are outputted thereby to the driving circuits 55*a* and 55*b*, respectively.

Accordingly, it is possible to vary the motor powers of both the motors 56*a* and 56*b* on the receiver side in the same amount simultaneously by operating one of the control sticks on the transmitter side, the control stick 41*a*. It is also possible to control the power balance of the motor 56*a* with respect to the motor 56*b* by operating the other control stick 41*b*. Therefore, the respective rotational outputs of the motors can be varied discretely from each other and/or continuously together between the minimum output and the maximum output for each.

Examples of operation of the toy airplane having the above-described construction will now be described.

By operating the transmitter of the radio control, first, both of the rotation outputs of the right and left propellers 26, 26 are increased in unison equally and gradually, and thereby the airplane can be made to take off. After the airframe has left the ground and flies into the air, the rotation outputs of the propellers are further increased uniformly together to the maximum and then the airframe ascends straight continuously. These maneuvers are performed by use only of the power output control stick 41*a* (the power balance control stick 41*b* having been set to provide a balance of equal power to each propeller). In other words, the second channel (CH2) is kept constant with an equal balance signal, and the first channel (CH1) is varied to accomplish the above maneuvers.

After the airframe reaches a prescribed altitude, it can be made to conduct a level flight by turning both of the rotation outputs of the right and left propellers 26, 26 to about 70, i.e. 70% of maximum, again moving only the control stick 41*a*.

Next, the airframe can be made to turn rightward by making the rotation output of the left propeller 26 higher than that of the right propeller 26. By setting the rotation output of the left propeller 26 at about 70 to 80 and that of the right propeller 26 at about 0 to 20, for instance, the propulsive force of the left propeller 26 becomes larger than that of the right propeller 26 and the airframe turns rightward. The airframe can be made to turn leftward by conducting a reverse operation to the above. These turning maneuvers are performed by use only of the power balance control stick 41*b*. However, if at the same time it is desired for any reason to increase or reduce the total combined power output of both propellers, then this can be done by operation of the power output control stick 41*a*.

Next, the airframe can be put in a descending or gliding state and made to return onto the ground by lowering both of the rotation outputs of the right and left propellers 26, 26 to 70 or below, or by turning them to 0 (for gliding).

By combining the above-stated operations, ascending and descending and turning rightward and leftward can be conducted arbitrarily.

Accordingly, with the toy airplane having the above described construction, arbitrary operations of ascending, descending and turning rightward and leftward can be performed by varying the rotation outputs of the right and left propellers 26, 26 discretely and continuously respectively. Thus, the elevators and rudders provided with the prior art toy airplanes are no longer needed. The horizontal tail plane 22 and the vertical tail planes 23, 23 can be put in fixed states, the complication of control servos and the mechanical components for controlling the elevator and rudder are dispensed with, the mechanism is simplified, and thereby the wight becomes lighter and the cost can be reduced.

Since the rotational outputs of the propellers 26, 26, and thus their propulsive forces, are controlled directly, responsiveness is higher than usually obtained when the conventional elevator and the rudder are controlled, and thus the operation of the toy in flight is facilitated. Since operation is executed by varying the rotational outputs of the propellers 26, 26, the power consumption to obtain these outputs can be lessened, and thus the lifetime of the battery 32 ca be prolonged.

The propeller assemblies 14 may be provided in one or more sets on the right and the left respectively. As a variant, a construction may be adopted wherein propellers for control, whose outputs can be varied discretely, are provided on the right and the left in addition to a single-motored propeller for propulsion. While the rotational outputs of the right and left propellers are made variable discretely and continuously in the above-described embodiment, in addition, they can also be varied in a staged manner between the minimum output and the maximum, for instance.

As will be appreciated, the above toy is operated and controlled without using or needing the conventional elevator and rudder controls. It is controlled solely by controlling the outputs of the right and left propellers via a radio control system which provides one hand control to vary total power output of the two propellers together and a separate hand control to vary the balance of power output between the two propellers.

The above described embodiments, of course, are not to be construed as limiting the breadth of the present invention. Modifications, and other alternative constructions, will be apparent which are within the spirit and scope of the invention as defined in the appended claims.

What is claimed is:

1. A toy airplane, comprising:

an airframe provided with a fixed vertical tail plane and a fixed horizontal tail plane;

two propellers rotatably mounted on opposite sides of the airframe;

rotating means for independently drivably rotating the two propellers;

power output means for controlling the combined total rotational output of the two propellers;

power balance means for adjustably proportioning the distribution of said combined total rotational output between the two propellers;

a radio control system incorporating said power output means and said power balance means for remote control of flight of the airframe;

said rotating means comprising two electric motors, one for each of said propellers;

a battery mounted in said airframe and connected through said radio control system to power said motors;

said radio control system comprising a radio receiver circuit mounted in said airframe, and a transmitter circuit for use remote from said airframe;

said transmitter circuit including a control stick for manually controlling said power output means and a separate control stick for manually controlling said power balance means;

said receiver circuit including a receiver antenna feeding a high-frequency amplifier circuit connected to a mixing circuit also input from a local oscillation circuit, an output from said mixing circuit being fed via an intermediate-frequency amplifier circuit and then an amplitude demodulation circuit to a decoder circuit which outputs in parallel a power control signal and a separate power balance signal; and said power control signal and said power balance signal being received by a further mixing circuit which in turn produces from these signals two control signals for separately driving said two motors.

2. A toy airplane, comprising:

an airframe provided with a fixed vertical tail plane and a fixed horizontal tail plane;

two propellers rotatably mounted on opposite sides of the airframe;

rotating means for independently drivably rotating the two propellers;

power output means for controlling the combined total rotational output of the two propellers;

power balance means for adjustably proportioning the distribution of said combined total rotational output between the two propellers;

a radio control system incorporating said power output means and said power balance means for remote control of flight of the airframe and;

said airframe being provided with a fixed main plane forwardly of the tail planes and forming a wing extending outwardly on each side of the airframe, said main plane and said horizontal tail plane having no adjustable elevators, and said vertical tail plane having no adjustable rudder.

3. The toy airplane of claim 2, wherein:

said rotating means comprises two electric motors, one for each of said propellers; and including a battery mounted in said airframe and connected through said radio control system to power said motors.

4. The toy airplane of claim 3, wherein:

said radio control system comprises a radio receiver circuit mounted in said airframe, and a transmitter circuit for use remote from said airframe; and said transmitter circuit including a control stick for manually controlling said power output means and a separate control stick for manually controlling said power balance means.

5. The toy airplane of claim 4, wherein said transmitter circuit further includes a clock circuit for generating a basic pulse and outputting to a modulation circuit to provide an input to a high-frequency modulation circuit connected with a high-frequency generating circuit for transmitting radio signals to said radio receiver circuit, said control sticks modifying the output of said clock circuit to said modulation circuit.

6. The toy airplane of claim 4, wherein said receiver circuit including a receiver antenna feeding a high-frequency amplifier circuit connected to a mixing circuit also input from a local oscillation circuit, an output from said mixing circuit being fed via an intermediate-frequency amplifier circuit and then an amplitude demodulation circuit to a decoder circuit which outputs in parallel a power control signal and a separate power balance signal.

7. The toy airplane of claim 2, wherein the airframe has a plurality of vertical tail planes, each being fixed and having no adjustable rudder.

8. A toy airplane, comprising:

a winged fuselage having a fixed tail plane assembly with not a single adjustable elevator or rudder anywhere;

right and left propeller units each having a separate electric motor and being mounted on opposite sides of said winged fuselage;

a control unit accommodated by the winged fuselage and including a circuit for receiving radio control signals; and said control unit including motor control means, responsive to received radio control signals, for:

(a) operating both of the drive motors in unison by proportionally increasing or decreasing the power to each motor, and (b) separately varying the power distribution between the two motors to enable either motor to run at higher power than the other, whereby flight of the winged fuselage is solely controlled by controlling the motors.

9. A toy airplane, comprising:

an airframe having a fixed tail assembly with not a single adjustable elevator or rudder anywhere;

two propeller units, one to a rightside of the airframe and the other to a leftside of the airframe;

each propeller unit including its own electric motor drivingly connected to a rotatable propeller;

a battery accommodated by the airframe for supplying power to the electric motors;

a radio receiver and motor control unit accommodated by the airframe and having two output channels, one output channel (CH1) controlling delivery of total combined power from the battery to both of the motors, and the other output channel (CH2) controlling distribution of this total combined power between the two motors; and a radio transmitter unit for transmitting radio signals from a remote location to said radio receiver and motor control unit, the radio transmitter unit having two separately operable user controls, one user control for determining and controlling said one output channel (CH1) and the other user control for determining and controlling said other output channel (CH2), whereby flight of the airframe is solely controlled by controlling the two motors.

* * * * *